United States Patent [19]

Gomi et al.

[11] Patent Number: 4,591,424

[45] Date of Patent: May 27, 1986

[54] METHOD OF PREPARING CARBONACEOUS PITCH

[75] Inventors: Shimpei Gomi, Tokyo; Tomio Arai, Zushi; Fumio Mogi, Tokyo; Takao Nakagawa, Ichikawa; Kunio Miura, Chiba; Sugio Otani, Kiryu, all of Japan

[73] Assignee: Fuji Standard Research, Inc., Tokyo, Japan

[21] Appl. No.: 611,072

[22] Filed: May 17, 1984

[30] Foreign Application Priority Data

Feb. 13, 1984 [JP] Japan ..... 59-24679

[51] Int. Cl.[4] ..... C10C 3/18

[52] U.S. Cl. ..... 208/40; 208/22; 208/39; 208/44

[58] Field of Search ..... 208/22, 40

[56] References Cited

U.S. PATENT DOCUMENTS

| | | | |
|---|---|---|---|
| 4,243,512 | 1/1981 | Seo | 208/22 |
| 4,454,020 | 6/1984 | Izumi et al. | 208/22 |
| 4,472,265 | 9/1984 | Otani | 208/22 |
| 4,504,455 | 3/1985 | Otani | 208/44 |
| 4,511,625 | 4/1985 | Nazem et al. | 208/22 |

FOREIGN PATENT DOCUMENTS

| | | | |
|---|---|---|---|
| 0057108 | 1/1982 | European Pat. Off. . | |
| 0056338 | 1/1982 | European Pat. Off. . | |
| 0054437 | 6/1982 | European Pat. Off. | 208/22 |
| 0086608 | 2/1983 | European Pat. Off. . | |
| 0089840 | 3/1983 | European Pat. Off. . | |
| 0084237 | 7/1983 | European Pat. Off. | 208/22 |
| 0099753 | 7/1983 | European Pat. Off. . | |
| 0045277 | 3/1983 | Japan | 208/22 |
| 53-134180 | 11/1983 | Japan . | |

*Primary Examiner*—John Doll
*Assistant Examiner*—Helane Myers
*Attorney, Agent, or Firm*—Pahl, Lorusso & Loud

[57] ABSTRACT

A method of preparing an carbonaceous pitch, including the steps of:

subjecting a raw material oil to thermal cracking conditions while removing cracked, light hydrocarbon components to obtain a pitch product containing at least 5 weight % of mesophase and not more than 10 weight % of light hydrocarbon components with a boiling point at 60 mmHg of 300° C. or less and having a softening point of between 160° and 220° C., the raw material oil being composed mainly of a residual oil which has a boiling point of 350° C. or more and which is derived from a naphthene base petroleum crude; and removing the mesophase from the pitch product to obtain a substantially mesophase-free carbonaceous pitch.

16 Claims, No Drawings

METHOD OF PREPARING CARBONACEOUS PITCH

BACKGROUND OF THE INVENTION

This invention relates to a method of preparing a carbonaceous pitch useful for use as a precursor material for carbon fibers.

As carbon fibers are increasingly applied in many fields, an attempt is now made to use them for incorporation into bodies of plastics, ceramics, concretes and metals. As precursor materials for carbon fibers, polyacrylonitrile fibers have been hitherto employed. Since the carbon fibers obtained from polyacrylonitrile fibers are expensive, however, a number of studies have been made in recent years to utilize carbonaceous pitch as raw materials for carbon fibers.

The general method for the production of carbon fibers from carbonaceous pitch includes melt spinning pitch into fibers, rendering the spun fibers infusible, and carbonizing the infusible fibers. To smoothly perform such a method, the properties of the raw material pitch are very important. The most important requirement is that the pitch must have a good spinnability. It is also important that the pitch must have properties so that the spun fibers obtained therefrom may be rendered infusible and carbonized without difficulty. Pitch which can meet with the above criteria has been hitherto considered to be of a type which is obtained by carefully thermally treating a raw material oil, such as a naphtha cracking residue, a recycle oil in fluidized bed catalytic cracking processes or a coal tar, which has a high content of aromatic components and a low content of impurities such as metals, inorganic matters and sulfur components. Thus, pitch derived from a low grade oil such as a vacuum residue or an atmospheric distillation residue has been considered to be unsuitable for use as a raw material pitch for the production of carbon fibers, since such a pitch has a poor spinnability.

Since the high grade raw material oils described above are relatively expensive and fail to give pitch with a high yield, the carbon fibers obtained therefrom are also expensive. Therefore, there is a great demand for carbonaceous pitch which is inexpensive and which has properties suitable for the production of carbon fibers.

In Japanese Published Unexamined Patent Application No. 57-100186, there is disclosed a method in which a mesophase pitch is hydrogenated to render the mesophase substantially soluble in quinoline. The pitch obtained by this method is termed "dormant mesophase pitch". The dormant mesophase pitch is optically isotropic in nature and, when heated above its melting point, is a homogeneous liquid in a single phase. When subjected to shear forces in one direction, the dormant mesophase pitch is converted into the optically anisotropic state by orientation, in the direction parallel to that direction, of its latently optically anisotropic components formed during the hydrogenation treatment of the mesophase pitch. While the dormant mesophase pitch has a good spinnability, the process for the production thereof has a drawback because it requires a hydrogenation step which makes the resulting pitch expensive.

SUMMARY OF THE INVENTION

The present invention provides a method of preparing a carbonaceous pitch, which comprises the steps of:

subjecting a raw material oil to thermal cracking conditions while removing cracked, light hydrocarbon components to obtain a pitch product containing at least 5 weight % of mesophase and not more than 10 weight % of light hydrocarbon components with a boiling point at 60 mmHg of 300° C. or less and having a softening point of between 160 and 220° C., the raw material oil being composed mainly of a residual oil which has a boiling point of 350° C. or more and which is derived from a naphthene base petroleum crude; and removing the mesophase from the pitch product to obtain a substantially mesophase-free carbonaceous pitch.

One of the features of the present invention resides in the use of a raw material oil composed mainly of a residual oil having a boiling point of 350° C. or more and being derived from a naphthene base petroleum crude (hereinafter referred to simply as "naphthenic raw material oil"). The advantages accruing from the use of the naphthenic raw material oil are as follows:

(1) The use of the naphthenic raw material oil makes it possible to produce a dormant mesophase-like pitch without resorting to a hydrogenation treatment. As described previously, the known process for the production of a dormant mesophase pitch requires the step of hydrogenating the mesophase of a mesophase pitch to render same substantially soluble in quinoline. In contrast, the pitch obtained according to the method of the present invention contains polycyclic, polycondensed ring aromatic hydrocarbons which have naphthenic rings and side chains and which can serve as latently optically anisotropic components, though the method does not include any hydrogenation step.

(2) Dehydrogenation, thermal decomposition and other reactions resulting in the formation of pitch in the case of using the naphthenic raw material oil proceed faster as compared with the case of using a residual oil derived from paraffin base petroleum crude. Therefore, the reaction time of the thermal cracking can be advantageously reduced. This is also advantageous because at least some of the naphthenic rings of the polycyclic, polycondensed ring aromatic hydrocarbons may remain undestroyed or unaromatized throughout the thermal cracking. That is, although the raw material oil is thermally cracked until a mesophase is formed in the matrix of the isotropic pitch, the isotropic matrix can still contain naphthenic ring-containing polycyclic, polycondensed ring aromatic hydrocarbons which may act as dormant anisotropic components.

(3) The pitch product obtained from the naphthenic raw material oil has a good thermal stability. Therefore, during the pitch forming reaction and during the subsequent spinning operation, the occurrence of coking is minimized.

(4) The removal of the mesophase from the mesophase pitch obtained by thermally cracking the naphthenic raw material oil can be effected easily by filtration. It has been found that when the naphthenic raw material oil is subjected to thermal cracking conditions according to the method of the present invention, a multiplicity of anisotropic small spheres (mesophase) having a particle size of 10 μm or less, generally between 1 and 5 μm, are formed at a relatively early stage of the reaction. Even with an increase in reaction time, the mesophase small spheres grow very sparingly in size and tend to aggregate, without coalescing with each other, to form botryoidally aggregated pitch particles having a particle size of 20–150 μm with each of the pitch spheres retaining its original spherical form. The botryoidal pitch particles, which are homogeneously dispersed within the matrix of the isotropic pitch, are easily separated by filtration from the matrix at an elevated temperature. The mesophase, which has a higher softening point than the isotropic matrix, exhibits solid-like behaviors at such a filtration temperature.

The substantially mesophase-free carbonaceous pitch obtained as a filtrate is very thermally stable. When heated above its melting point, for example at a temperature of about 300° C., no mesophase is newly formed. Fine mesophase particles which failed to be removed during the filtration step and which may trace be present in the carbonaceous pitch never grow in size to the extent that they adversely affect the spinnability of the pitch. Further, the amount of the low molecular weight components in the carbonaceous pitch is small and the molecular weight of the pitch is distributed in relatively high and narrow range. All of the above properties of the carbonaceous pitch allow the use thereof as precursor materials for the production of carbon fibers.

When a paraffin base petroleum crude is used as a raw material oil for the preparation of the pitch, the rate at which the pitch is formed becomes low. The resulting pitch is not thermally stable and coking is liable to occur during the thermal cracking step. Further, the mesophase spheres tend to coalesce with each other to form large mesophase particles having a diameter of between 200 and 1000 μm. The mesophase particles which are heterogeneously distributed in the matrix of isotropic pitch are very difficult to separate from the matrix by filtration in the molten state. In addition, the fine particles of mesophase contained in the filtrate can coalesce with each other to form large mesophase particles which adversely affect the spinnability of the pitch.

It is, therefore, an object of the present invention to provide a method by which a carbonaceous pitch suitable for use as a precursor material for carbon fibers can be prepared at low costs.

Other objects, features and advantages of the present invention will become apparent from the detailed description of the present invention to follow.

DETAILED DESCRIPTION OF THE INVENTION

The raw material oil used in the method of the present invention is an oil composed mainly of a residual oil which has a boiling point of 350° C. or more and which is derived from a naphthene base petroleum crude. The term "naphthene base petroleum crude" is defined by UOP characterization factor classification method as a crude oil having a characterization factor K of between 11.0 and 11.5. The characterization factor K is expressed by:

$$K = \sqrt[3]{T_B}/S$$

where $T_B$ stands for a molar average boiling point in terms of Rankine temperature (° F.+460) and S stands for a specific gravity at 60° F. of the distillate. Illustrative of suitable naphthene base crude oils are California crude, Coalinga crude, Texas crude, Bachaquero crude, Merey crude, Boscan crude, Maya crude, Klamono crude, Seria crude and Nigeria crude. The term "residual oil from naphthene base petroleum crude" is intended to mean a heavy fraction, such as an atmospheric residue, a vacuum residue, a vacuum distillate or asphalt from a solvent deasphalting process, having a boiling point of 350° C. or more. The asphalt from a solvent deasphalting process is that obtained by subjecting a residual oil such as an atmospheric residue to an extraction treatment using as an extraction solvent propane, butane, pentane, etc.

A residual oil containing a large amount of metal components and sulfur components may be used for the purpose of the present invention if the inclusion of such components in the final carbon fibers is allowable. Further, a residual oil having a large residual carbon content (Conradson carbon residue) may also be used for the purpose of the present invention. The use of such a residual oil is rather preferred since the yield of pitch becomes higher with the increase of the residual carbon content. The above-described residual oils generally belong to poor grade heavy hydrocarbon oils and are regarded as being unsuited for the production of carbon fibers.

If desired, the raw material oil can contain other residual oils, such as those derived from paraffin base or intermediate base petroleum crude, than that derived from naphthene base petroleum crude. Generally, the content of the residual oil derived from naphthene base petroleum crude in the raw material oil is 45 weight % or more, preferably 60 weight % or more. It is also preferred that the residual oil derived from naphthene base petroleum crude be contained in the raw material oil in an amount so that at least half of the pitch obtained by the thermal cracking step is composed of components derived from the naphthene base petroleum crude.

The raw material oil is thermally cracked, while removing, generally continuously, cracked light hydrocarbons, at a temperature of between about 350° and 500° C., preferably between 400° and 440° C. so that a pitch is formed by polycondensation and other reactions inherent to the thermal cracking. It is preferred that the removal of the cracked light hydrocarbon products be conducted by maintaining the reaction zone under a reduced pressure for the evaporation of the light hydrocarbons formed by the thermal cracking or by continuously feeding a gaseous heat transfer medium to the reaction zone for contact with the raw material oil. The heat transfer medium serves both to supply heat necessary for effecting the thermal cracking and to strip volatile cracked products and is preferably a substantially oxygen-free, non oxidative gas such as steam, a hydrocarbon gas or vapor, a perfect combustion waste gas, nitrogen or hydrogen.

The thermal cracking is performed in a liquid phase under a reduced pressure, generally at a pressure of between 5 and 500 mmHg (absolute) or under a partial pressure of hydrocarbon vapor of between 5 and 500 mmHg. When the raw material oil contains relatively low boiling point fractions (boiling at 350°–500° C.) such as atmospheric residue or vacuum distillate (VGO), the early stage of the thermal cracking may be suitably effected under a pressure of generally between 1 and 10 Kg/cm$^2$ so as to increase the yield of the pitch. The reaction time is generally in the range of between 0.3 and 10 hours, though the reaction time varies according to the kind of the raw material oil to be thermally cracked. The thermal cracking may be carried out with the use of any known liquid phase cracking reactors in a continuous, batch or semi-batch (generally adopted in Eureka process) mode.

The thermal cracking is conducted so that the pitch product contains at least 5 weight %, generally between 5 and 40 weight %, preferably between 10 and 25 weight % of mesophase and not more than 10 weight %, preferably not more than 5 weight % of light hydrocarbon components with a boiling point at 60 mmHg (absolute) of 300° C. or less and has a softening point of between 160° and 220° C., preferably between 170° and 210° C.

It is important that the thermal cracking should be conducted at a temperature and for a period of time so that at least 5 weight % of mesophase is formed. If the thermal cracking is stopped before the formation of mesophase, the molecular weight of the resulting pitch is too small to give spun fibers of a satisfactory strength. The formation of at least 5 weight % of mesophase is necessary to obtain a pitch suitable for spinning into fibers.

The content of the light fraction is also important for the pitch to have a suitable spinnability. The content of light hydrocarbon components above 10 weight % is disadvantageous because the pitch fibers tend to be broken during spinning and because it becomes difficult to render the spun fibers infusible. The content of the light hydrocarbon components in the pitch can be controlled by adjusting the feed rate of the gaseous heat transfer medium or the degree of vacuum pressure.

When the softening point of the pitch product is below 160° C., the stability of the carbonaceous pitch obtained by removal of mesophase therefrom becomes poor and it becomes also difficult to render the spun fibers infusible. A softening point of the pitch product above 220° C. is also undesirable because the pitch product will have a greater amount of mesophase, resulting in the decrease in yield of the carbonaceous pitch. Too high a softening point also makes the spinning operation difficult to perform. The term "softening point" used in the present specification is measured by means of a Koka-type flow tester manufactured by Shimadzu Seisakusho Co., Ltd. and is a temperature at which the sample commenced to flow through a nozzle having a diameter of 1 mm when heated at a rate of 6° C./min under a pressure of 10 $Kg/cm^2$.

The thus obtained pitch product containing mesophase dispersed in the matrix of isotropic pitch is then separated into the mesophase and substantially mesophase-free carbonaceous pitch. A polarized-light microscopy reveals that the mesophase contained in the pitch product has a mosaic structure composed of very fine particle units having a diameter of between 1 and 5 μm. The fine particle units aggregate during the thermal cracking to form botryoidal, aggregated particles with a size of between 25 and 150 μm homogeneously dispersed in the matrix of isotropic pitch. Under the reaction conditions, the mesophase particles or their aggregated particles do not coalesce with each other. Therefore, at a temperature above the melting point of the isotropic matrix but below the softening point of the mesophase, generally at a temperature between 250° and 400° C., the mesophase can be easily separated by filtration in the form of a cake.

As described previously, the formation of such easily separable mesophase is considered to be ascribed to the use of the specific raw material oil. In comparison with the pitch obtained, in the same manner as in the method of the present invention, by thermal cracking of a residual oil derived from paraffin base petroleum crude, the mesophase pitch particles or their aggregated particles obtained in accordance with the present invention have a relatively small particle size and are homogeneously dispersed in the matrix of isotropic pitch which, in molten state, has a relatively high viscosity. On the other hand, the mesophase obtained from the paraffin base petroleum crude has a large particle size, generally of between 200 and 1000 μm and does not form a cake when filtered. If the mesophase is forced to be separated by filtration, then the filtrate will contain mesophase particles having a particle size of 30 μm or more as well as fine mesophase particles. Thus, it is not possible to obtain a substantially mesophase-free carbonaceous pitch by filtration of the pitch product obtained from the paraffin base petroleum crude.

The mesophase separated by filtration from the pitch product contains a large amount of quinoline insolubles and, further, a larger amount of nickel, vanadium and other metal components than the filtrate does. The metal components contained in the raw material oil are caught by or bound to mesophase, such as in the form of organo-metallic salts or porphyrin complexes, to form fine, quinoline insoluble-rich, higher softening point (than the isotropic matrix), solid-like mesophase particles. Thus, it is believed that metal components contained in the raw material oil contribute to the good separability of the mesophase formed in accordance with the method of the present invention.

The removal of mesophase from the pitch product may be suitably performed by filtration, by application of a pressure or under reduced pressure, at an elevated temperature. Other solid-liquid separation methods such as centrifuge and sedimentation may also be used. Since the mesophase contains metal components, a high gradient magnetic separation method or an electrical method may be adopted for the separation of the mesophase.

The substantially mesophase-free carbonaceous pitch obtained by the method of the present invention has a H/C (a hydrogen to carbon atomic ratio) of between 0.55 and 1.2, a high molecular weight, a narrow molecular weight distribution and a good thermal stability. In the molten state, the pitch is in a single phase. The pitch is soluble in quinoline and is isotropic in nature. The pitch has thus a very excellent spinnability and can be spun into fibers at a high spinning rate. Further, because of the presence of a significant amount of polycyclic, polycondensed ring aromatic hydrocarbons with naphthenic rings, the carbonaceous pitch obtained by the method of the present invention is latently optically anisotropic and can give carbon fibers having a high mechanical strength. If desired, the carbonaceous pitch thus obtained can be subjected once or more times to thermal cracking and subsequent mesophase removal treatments to control the molecular weight of the carbonaceous pitch and to reduce the amount of metal components in the carbonaceous pitch. The carbon fibers can be up-graded by such repeated treatments.

The results of the measurement of various physical properties of the carbonaceous pitch obtained by the method of this invention by means of a proton NMR, $^{13}C$-NMR, elementary analysis and the like have revealed the following:

(1) Proton NMR spectrum shows a sharp absorption at 1.5–2.0 ppm indicating the presence of naphthenic rings. In comparison with the pitch obtained from paraffin base petroleum crude, the pitch of the present invention has much more naphthenic hydrogen at $\beta$ or more remote positions from aromatic ring. The Z value (a ratio of the number of aliphatic hydrogen atoms to the number of aliphatic carbon atoms) is in the range of between 1 and 2, indicating that the naphthenic ring is a condensed ring.

(2) $R_a$ value, which represents the number of aromatic rings determined with the proviso that the aromatic rings of the pitch molecule are in a peri-type structure, is large. This indicates that the molecule has a polycyclic, polycondensed ring structure.

(3) The content of hydrogen atoms bonded to carbon atoms located at $\beta$ or more remote positions from aromatic carbon atoms is higher than that at $\alpha$-positions. This characteristic is common to pitch derived from petroleum residual oils and suggests the presence of naphthenic rings and aliphatic side chains in the pitch molecule.

(4) The measurement of molecular weight by vapor pressure osmosis method (V.P.O. method) for pitch derived from a naphthenic raw material oil and from a paraffin base raw material oil reveals that the former pitch has a higher molecular weight than the latter pitch. (The two pitch samples had approximately the same softening point.)

(5) Hydrogen donating properties of naphthene base and paraffin base raw material oils and the pitch obtained therefrom are examined by heat-treating the sample in the presence of anthracene to measure the yield of 9,10-dihydroanthracene by means of proton NMR spectrometer. The results shows that the naphthenic raw material oil and the pitch derived therefrom can provide a larger amount of hydrogen transferable to anthracene as compared with the paraffin base raw material oil and its pitch, respectively. Thus, when the naphthenic raw material oil is subjected to thermal cracking conditions, various radicals produced by the thermal cracking can be stabilized by reaction with the transferable hydrogen supplied by the raw material oil. Therefore, the pitch derived from the naphthenic raw material oil is more thermally stable than that from the paraffin base raw material oil.

The substantially mesophase-free pitch obtained by the method of this invention can be spun into fibers at a temperature of between 250° and 310° C. at a high spinning rate in any know manner. The spun fibers are then heat-treated, generally at a temperature of up to 300° C. in the conventional manner in the oxidizing atmosphere such as in the atmosphere of air or $NO_2$-containing air for rendering the spun fibers infusible. The infusible fibers are then carbonized in the conventional manner, generally at a temperature of 1000° C or more to obtain carbon fibers. Though the substantially mesophase-free pitch as obtained is optically isotropic in nature, it becomes optically anisotropic during the spinning step because of the orientation of latently optically anisotropic components in the pitch in the direction parallel to the fiber axis. Therefore, the resultant carbon fibers exhibit both a high tensile strength and a high modulus as compared with the conventional isotropic pitch.

Whilst the pitch of the present invention is especially suited as precursor materials for carbon fibers, it is also utilizable in the same way as the conventional pitch, for example, as a raw material for graphite.

The following examples will further illustrate the present invention.

EXAMPLE 1

Venezuelan Bachaquero crude, being a naphthene base petroleum crude, was distilled at atmospheric pressure and the bottom was subjected to vacuum distillation to obtain, with a yield of 45.3 vol %, a residual oil whose physical properties are shown in Table 1.

TABLE 1

| Properties of Residual Oil | |
|---|---|
| Specific gravity (25/25° C.) | 1.02 |
| Conradson carbon residue (wt %) | 21.6 |
| Sulfur content (wt %) | 3.37 |
| Nickel content (ppm) | 98 |
| Vanadium content (ppm) | 748 |

One Kg of the residual oil was charged in a 2 liter autoclave equipped with an agitator and was thermally cracked therein at a temperature of 425° C. and a pressure of 1.1 Kg/cm$^2$ (absolute) for 45 min. The thermal cracking was performed in a liquid phase while continuously feeding superheated steam at a rate of 1 g/min. The cracked gas and cracked light hydrocarbon oil were continuously withdrawn overhead from the autoclave together with the superheated steam for recovery. The partial pressure of hydrocarbon gases within the autoclave was maintained at 300 mmHg throughout the thermal cracking by controlling the feed rate of the superheated steam. As a result, about 4 weight % of cracked gas, about 64 weight % of cracked oil and about 33 weight % of pitch were obtained. The properties of the pitch were as shown in Table 2.

TABLE 2

| Properties of Pitch | |
|---|---|
| Softening point (°C.) | 182 |
| Volatile matter (wt %) | 44.5 |
| Content of fraction boiling at below 300° C. at 60 mmHg absolute (wt %) | below 1 |
| Metal (V and Ni) content (wt-ppm) | 2600 |
| Sulfur content (wt %) | 4.2 |
| n-Heptane insolubles (wt %) | 76.0 |
| Quinoline insolubles (wt %) | 9.6 |

The pitch was found, by polarized light microscopy, to contain mesophase in an amount of 20 % in terms of the area of polarized domain. The mesophase had a mosaic structure composed of very fine mesophase particle units having a diameter of 1–6$\mu$m. The mesophase units formed aggregated particles of a botryoidal shape having a size of 50–100 $\mu$m.

100 g of the mesophase pitch was heated to 300° C. in the atmosphere of nitrogen and filtered using 500 mesh metal sieve having an effective area of 25 cm$^2$ under a reduced pressure of 10 mmHg (absolute), whereby 55 g of a filtrate was obtained. The filtration was able to be conducted easily and within a short period of time. The filtrate was found by polarized light microscopy to contain almost no mesophase and to be optically isotropic. The pitch had a softening point of 179° C. and contained 46.5 weight of of volatile matters, 0.1 weight % of quinoline insoluble matters and 2030 wt-ppm of metal components (Ni and V). When the surface of the pitch was rubbed in one direction by a filter paper, there was developed a definite molecular orientation in the direction of the rub, indicating that the pitch was a dormant mesophase pitch.

In order to investigate the structure of the pitch, various physical properties of the pitch were measured by proton NMR, $^{13}$C-NMR, elementary analysis and vapor pressure osmosis. NMR analysis was made with the use of a high resolution nuclear magnetic resonance spectrometer (Varian Inc.) using $CDCl_3$ as solvent. Brown-Ladner method and its improved method were adopted to analyze the data and to calculate respective parameters. The proton NMR spectrum showed a sharp absorption at a δ-value of 1.5–2.0 ppm attributed to the protons of naphthene ring. The results were as shown in Tables 3 and 4 together with those of Comparative Example described hereinafter. In Tables 3 and 4, the letters or symbols mean as follows:

B/Q pitch: Pitch obtained from a residual oil derived from Bachaquero crude (pitch obtained according to the method of the present invention)

A/L pitch: Pitch obtained from a residual oil derived from Arabian Light crude (Comparative Example)

$H_a$: Content of hydrogen on aromatic rings $H_\alpha$: Content of hydrogen at α-positions $H_N$: Content of hydrogen on naphthene rings at β or more remote positions $H_\beta$: Content of hydrogen on side chains at β or more remote positions except terminal methyl groups at γ or more remote positions $H_\gamma$: Content of hydrogen of terminal methyl groups on side chains at γ or more remote positions $f_a$: Ratio of the number of aromatic carbon atoms to the total number of carbon atoms, measured value by $^{13}C$-NMR $M_w$: Molecular weight by V.P.O.

$\#C_a$: Number of aromatic carbon atoms per one molecule $\#C_s$: Number of aliphatic carbon atoms per molecule Z : Ratio of the number of hydrogen atoms bonded to aliphatic carbon to the number of aliphatic carbon atoms $R_a$: Number of aromatic rings in one molecule provided that the rings are condensed ring of a peri-type $\#H_N$: Number of hydrogen atoms on naphthene rings at β or more remote positions For the purpose of the present specification, the terms "aromatic hydrogen", "aliphatic hydrogen" and "naphthenic hydrogen" are intended to refer to hydrogen atoms bonded to an aromatic carbon atom, an aliphatic carbon atom and a naphthenic carbon atom, respectively, and the greek letters are assigned to non-aromatic carbon atoms, i.e. aliphatic and naphthenic carbon atoms, in which the enumeration starts with each of the aliphatic and naphthenic carbon atoms located adjacent to aromatic carbon atoms. ( See K. D. Bartle and J. A. Smith, *Fuel*, vol 46, p 29 (1967), the disclosure of which is hereby incorporated by reference.)

TABLE 3

| Sample | $H_a$ (%) | $H_\alpha$ (%) | $H_N$ (%) | $H_\beta$ (%) | $H_\gamma$ (%) |
|---|---|---|---|---|---|
| B/Q-pitch | 20.59 | 17.04 | 16.33 | 31.24 | 14.20 |
| A/L-pitch | 32.43 | 22.56 | 19.74 | 19.74 | 5.64 |

TABLE 4

| Sample | $f_a$ | $M_w$ | $\#C_a$ | $\#C_s$ | Z | $R_a$ | $\#H_N$ |
|---|---|---|---|---|---|---|---|
| B/Q-pitch | 0.61 | 1290 | 52.6 | 33.6 | 1.6 | 16.2 | 12.1 |
| A/L pitch | 0.63 | 890 | 36.7 | 21.5 | 1.4 | 9.0 | 9.4 |

As will be seen from Tables 3 and 4, the values of $\#H_N$ and Z are high in B/Q pitch. This fact, when taken in conjunction with the sharp absorption at 1.5–2.0 ppm in proton NMR spectrum, indicates the presence of a larger amount of naphthene rings as compared with A/L pitch. Further, in view of the fact that the values $M_w$ and $R_a$ are high, the B/Q pitch contains polycyclic, polycondensed ring aromatics. The fact that the amount of hydrogen at β or further positions is higher than $H_\alpha$(total of $H_N$, $H_\beta$ and $H_\gamma$ amounts to over 50 %), also shows the presence of naphthene rings.

Next, the filtrate was spun into fibers through a nozzle having a diameter of 0.3 mm and a L/D of 3. The spinning was performed at a temperature of 280° C. and a spinning pressure of 1.8 $Kg/cm^2G$. Fibers having a diameter of about 15 μm were obtained at a rate of 500 m/min in an extremely stable manner.

The spun fibers were then heated from 100° to 150° C. at a heating rate of 1° C./min in the atmosphere of air containing 1% of $NO_2$. After being maintained at 150° C. for 30 min, the fibers were heated up to 250° C. at a heating rate of 1° C./min in the air and finally maintained at 250° C. for 30 min so that the fibers were rendered infusible.

The infusible fibers were then heated at a rate of 5° C./min to 1000° C. and maintained at that temperature for 30 min for carbonization. The resultant carbon fibers had a diameter of 14 μm, a tensile strength of 13 $ton/cm^2$, a modulus of 340 $ton/cm^2$ and an elongation of 3.0 %. The yield of the carbon fibers on the basis of the pitch was about 72 weight %.

COMPARATIVE EXAMPLE

Arabian Light crude being a paraffin base petroleum crude was distilled under atmospheric pressure and the bottom was subjected to vacuum distillation to obtain a residual oil having the properties shown in Table 5. The yield of the residual oil was 18.4 vol %.

TABLE 5

| Properties of Residual Oil | |
|---|---|
| Specific gravity (25/25° C.) | 0.997 |
| Conradson carbon residue (wt %) | 19.2 |
| Sulfur content (wt %) | 4.15 |
| Nickel content (ppm) | 19.9 |
| Vanadium content (ppm) | 79.0 |

One Kg of the residual oil was subjected to thermal cracking in the same manner as described in Example 1. As a result 4 weight % of cracked gases, 73 weight % of cracked oils and 23 weight % of pitch were obtained. The thermal cracking was performed for 80 min. The physical properties of the pitch was as shown in Table 6.

TABLE 6

| Properties of Pitch | |
|---|---|
| Softening point (°C.) | 185 |
| Volatile matter (wt %) | 39.3 |
| Content of fraction boiling at below 300° C. under below 60 mmHg (absolute) (wt %) | below 1 |
| Metal content (V and Ni) (wt-ppm) | 250 |
| Sulfur content (wt %) | 6.9 |
| n-Heptane insolubles (wt %) | 83.7 |
| Quinoline insolubles (wt %) | 18.1 |

The pitch was found, by polarized light microscopy, to contain mesophase of a mosaic structure. The particle units constituting the mesophase were found to contain those having a diameter of over 10 μm. The mesophase particles were aggregated with each other to form botryoidal particles having a size of 200–1000 μm and being dispersed in the pitch. The pitch was found to contain about 30 % of mesophase by polarized light microscopy. 100 g of the pitch was then subjected to filtration in the same manner as described in Example 1. However, it was not possible to completely filter the pitch. Only 10 g was obtained on the filter with the residual liquid being remained unseparated. The filtrate was revealed to contain mesophase or its aggregated particles. The filtrate had a softening point of 181° C., volatile matter content of 40 weight %, quinoline insoluble content of 3 weight % and metal content (V and Ni) of 220 ppm. The results of analysis of the properties of the filtrate are shown in Tables 3 and 4. The proton NMR spectrum of the filtrate did not show clear peak typical to naphthenic hydrogen. The results shown in Tables 3 and 4 indicate that the pitch derived from paraffin base petroleum crude has a low molecular weight, a low content of aromatic rings in one molecule and a low amount of hydrogen bonded to naphthene rings.

The pitch was spun using the same nozzle as used in Example 1 at a spinning temperature of 285° C., a spinning pressure of 1.5 Kg/cm2G and a spinning rate of 400 m/min. The spinning operation was very difficult to perform because of frequent breakage of the spun fibers. The spun fibers were then rendered infusible and carbonized in the same manner as that in Example 1 to obtain carbon fibers having a diameter of 24 μm, a tensile strength of 6 ton/cm$^2$, a modulus of 371 ton/cm$^2$and an elongation of 1.9 %.

EXAMPLE 2

A mixed oil having the formulation shown in Table 7 was distilled at atmospheric pressure and the bottom was subjected to vacuum distillation to obtain a residual oil having a boiling point of above 538° C. with a yield of 34 vol %.

TABLE 7

| Formulation of Mixed Oil | |
|---|---|
| Crude Oils | Content |
| Iranian Heavy | 47 vol % |
| Bachaquero | 33 |
| Maya | 12 |
| Arabian Light | 7 |

When each of the crude oils was subjected to the similar two stage distillation, the yield and the properties of its residual oil having a boiling point of above 538° C. were as shown in Table 8. From the results shown in Tables 7 and 8, the residual oil obtained from the mixed oil is considered to have the composition shown in Table 9.

TABLE 8

| Yields and Properties of Residual Oils | Iranian Heavy | Bachaquero | Maya | Arabian Light |
|---|---|---|---|---|
| Yield (vol %) | 25.8 | 45.3 | 41.5 | 18.4 |
| Specific gravity (25/25° C.) | 1.017 | 1.02 | 1.046 | 0.997 |
| Conradson carbon residue (wt %) | 19.7 | 21.6 | 24.8 | 19.2 |
| Sulfur content (wt %) | 3.42 | 3.37 | 5.38 | 4.15 |
| Nickel content (wt-ppm) | 94 | 98 | 130 | 19.9 |
| Vanadium content (wt-ppm) | 241 | 748 | 564 | 79 |

TABLE 9

| Composition of the Residual Oil from the Mixed Oil | Content | |
|---|---|---|
| Residual Oil | vol % | wt % |
| Iranian Heavy | 36.4 | 36.2 |
| Bachaquero | 44.8 | 44.7 |
| Maya | 14.9 | 15.2 |
| Arabian Light | 3.9 | 3.9 |

One Kg of the residual oil obtained from the mixed oil was thermally cracked in the same manner as that in Example 1 to obtain 5 weight % of cracked gases, 60 weight % of cracked oils and 33 weight % of pitch. The cracking was performed for 75 min. The pitch had the properties shown in Table 10.

TABLE 10

| Properties of Pitch | |
|---|---|
| Softening point (°C.) | 183 |
| Volatile matters (wt %) | 42.0 |
| Content of fraction boiling at below 300° C. at 60 mmHg (absolute) (wt %) | below 1 |
| Metal content (Ni and V) (wt-ppm) | 1540 |
| Sulfur content (wt %) | 5.35 |
| n-Heptane insolubles (wt %) | 78.6 |
| Quinoline insolubles (wt %) | 20.0 |

Polarized light microscopy of the pitch revealed the presence of fine mesophase particles in the mosaic structure. The finie particles having a diameter of 1–6 μm formed botryoidal, aggregated particles having a diameter of 50–100 μm homogeneously dispersed in the pitch. The mesophase content was about 25% when determined by polarized light microscopy.

100 g of the pitch was then filtered in the same manner as in Example 1 to obtain 50 g of a filtrate. The solids phase (mesophase) separated formed a cake with a thickness of about 10 mm on the metal sieve. The separation by filtration was able to be carried out smoothly and easily. The filtrate was found to contain almost no mesophase as a result of polarized light microscopic observation. The filtrate was substantially isotropic in nature and had a softening point of 179° C., a volatile matter content of 43.8 weight %, a quinoline insoluble content of 0.8 weight % and a metal content (Ni and V) of 1200 ppm.

The filtrate was then spun into fibers with the use of the same spinning device as used in Example 1. The spinning was performed at a spinning temperature of 280° C., a spinning pressure of 1.8 Kg/cm$^2$ and a spinning rate of 500 m/min. The spun fibers had a diameter of about 15 μm and were thermally stable. The spun fibers were then rendered infusible and carbonized in the same manner as in Example 1 to obtain carbon fibers having a diameter 14 μm, a tensile strength of 9.2 ton/cm$^2$, a modulus of 360 ton/cm$^2$ and an elongation of 2.8 %. The yield of the carbon fibers was about 75 weight % based on the pitch.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

We claim:

1. A method of preparing an optically isotropic carbonaceous pitch which is convertible inot optically anisotropic pitch when subjected to shear forces, said method comprising the steps of:

providing a raw material oil comprising at least 45% of a residual oil having a boiling point of 350° C. or more and obtained from fractionation of a naphthene base petroleum crude, said napbtbene base petroleum crude having a characterization factor K of between 11.0 and 11.5, said factor K defined as:

$$K = \sqrt[3]{T_B} / S$$

wherein $T_B$ is the molar average bioling point in Rankine (° F.+460) and S is the specific gravity at 60° F. of the distillate;

thermally cracking said raw material oil in a reaction zone to remove light hydrocarbon components and to obtain a pitch product containing 5–40 weight % of mesophase and not more than 10 weight % of light hydrocarbon components with a bioling point at 60 mmHg (absolute) of 300° C. or less and having a softening point of between 160° and 220° C.; and removing the mesophase from said pitch product to obtain a substantially mesophase-free carbonaceous pitch as said optically isotropic pitch.

2. A method as claimed in claim 1, wherein said thermal cracking is performed while maintaining the reaction zone under a reduced pressure so that the cracker light hydrocarbon components are continuously removed from said reaction zone.

3. A method ad claimed in claim 1, wherein said thermal cracking is performed while continuously feeding a gaseous heat transfer medium so that the cracked light hydrocarbon components are continuously removed by stripping from said reaction zone.

4. A method in accordance with claim 3 wherein said heat-transfer medium is a substantially oxygen-free, non-oxidative gas which supplies the heat necessary for effecting said thermal cracking.

5. A method in accordance with clalm 4 wherein said heat transfer medium is selected from the group consisiting of steam, hydrocarbons, perfect combustion waste gas, nitrogen and hydrogen.

6. A method in accordance with claim 1 wherein said thermal cracking is conducted at a pressure of between 5 to 500 mm Hg (absolute.)

7. A method in accordance with claim 1 wherein said thermal cracking is conducted at a partial pressure of hydrocarbon vapor of between 5 and 500 mm Hg.

8. A method as claimed in claim 1, wherein said removing step is effected by filtration at an elevated temperature.

9. A method as claimed in claim 1, wherein the thermal cracking is conducted so that said mesophase-free pitch contains polycyclic, polycondensed ring aromatic hydrocarbons having naphthenic rings and aliphatic side chains and has a greater number of hydrogen atoms bonded to non-aromatic carbon atoms located at $\beta$ or more remote positions the number of hydrogen atoms bonded to non-aromatic carbon atoms located at $\alpha$ positions.

10. A method in accordance with claim 1 wherein said pitch product contains 10–25% weight mesophase and no more than 5 weight % of said light hydrocarbon components.

11. The method of claim 1 wherein said thermal cracking is conducted at 350° to 500° C.

12. The method of claim 1 wherein said thermal cracking is conducted at 400° to 440° C.

13. The method of claim 1 wherein said mesophase formed by thermal cracking is in the form of botryoidal aggregates between 25 and 150 $\mu$m homogeneously dispersed in the matrix of isotropic pitch.

14. A process in accordance with claim 1 wherein said separation is by filtration, sedimentation, centrifugation or high gradient magnetic separation.

15. A process in accordance with claim 1 wherein said separation is by filtration.

16. A process in accordance with claim 1 wherein said residual oil contains metal impurities and wherein the major portion of the metal impurities is removed with the mesophase from the pitch product.

* * * * *

UNITED STATES PATENT AND TRADEMARK OFFICE

CERTIFICATE OF CORRECTION

PATENT NO. : 4,591,424

DATED : May 27, 1986

INVENTOR(S) : GOMI et al

It is certified that error appears in the above—identified patent and that said Letters Patent is hereby corrected as shown below:

Col 12, line 31 "finie" should read --fine--.

Col 13, line 2 "inot" should read --into--;

line 9 "napbtbene" should read --naphthene--;

line 25 "bioling" should read --boiling--;

line 33 "cracker" should read --cracked--; and line 38 after "medium" insert --to the reaction zone--.

Col 14, line 3 "siting" should read --sting--;

line 11 after "said" insert --mesophase--; and line 20 after "positions" insert --than--.

Signed and Sealed this

Thirteenth Day of January, 1987

*Attest:*

DONALD J. QUIGG

*Attesting Officer*

*Commissioner of Patents and Trademarks*